US011536095B2

(12) United States Patent
Arsoski

(10) Patent No.: US 11,536,095 B2
(45) **Date of Patent: *Dec. 27, 2022**

(54) SLIMLINE STOP COLLAR WITH SOLID CAM RING

(71) Applicant: DOWNHOLE PRODUCTS LIMITED, Aberdeen (GB)

(72) Inventor: Darko Arsoski, Angus (GB)

(73) Assignee: DOWNHOLE PRODUCTS LIMITED, Portlethen (GB)

( * ) Notice: Subject to any disclaimer, the term of this patent is extended or adjusted under 35 U.S.C. 154(b) by 123 days.

This patent is subject to a terminal disclaimer.

(21) Appl. No.: 17/162,381

(22) Filed: Jan. 29, 2021

(65) Prior Publication Data

US 2021/0285292 A1 Sep. 16, 2021

Related U.S. Application Data

(60) Provisional application No. 62/987,923, filed on Mar. 11, 2020.

(51) Int. Cl.
*E21B 17/16* (2006.01)
*E21B 17/043* (2006.01)

(52) U.S. Cl.
CPC ..... *E21B 17/16* (2013.01); *E21B 17/043* (2013.01)

(58) Field of Classification Search
CPC ..... E21B 17/02; E21B 17/043; E21B 17/006; E21B 17/16
See application file for complete search history.

(56) References Cited

U.S. PATENT DOCUMENTS 2,824,613 A * 2/1958 Baker ..... E21B 17/1028 166/241.7
2,855,052 A 10/1958 Wright
3,799,277 A * 3/1974 Kellner ..... E21B 4/18 175/94
4,101,179 A 7/1978 Barron
4,105,262 A * 8/1978 Richey ..... E21B 17/1078 175/325.2
4,384,626 A 5/1983 Derouin
5,860,760 A * 1/1999 Kirk ..... F16B 7/149 403/374.1

(Continued)

FOREIGN PATENT DOCUMENTS

EP 3633136 A1 * 4/2020 ..... B25B 27/10

OTHER PUBLICATIONS

Office Action dated Oct. 28, 2021 for U.S. Appl. No. 16/535,954 (8 pages).

(Continued)

*Primary Examiner* — David Carroll

(57) ABSTRACT

A stop collar for mounting to a downhole tubular includes: a cylindrical housing having a threaded inner surface and a tapered inner surface; a compressible slip ring having teeth formed in an inner surface thereof and a pair of tapered outer surfaces; a solid cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular.

15 Claims, 7 Drawing Sheets

(56) References Cited

U.S. PATENT DOCUMENTS

| | | | | |
|---|---|---|---|---|
| 8,832,906 | B2 | 9/2014 | Buytaert | |
| 9,598,913 | B2 | 3/2017 | Buytaert | |
| 9,963,942 | B2 | 5/2018 | Eidem | |
| 9,982,494 | B2 | 5/2018 | Steine | |
| 2003/0006609 | A1* | 1/2003 | Yates | F16L 37/0915 285/39 |
| 2009/0255666 | A1 | 10/2009 | Olsen | |
| 2016/0376852 | A1 | 12/2016 | Gynz-Rekowski | |
| 2020/0109607 | A1* | 4/2020 | Mackay | B25B 27/10 |

OTHER PUBLICATIONS

Extended European Search Report dated Jul. 13, 2021 and reported Jul. 22, 2021 for EP app. No. 21155419.1-1002 (7 pages).
Eurasian Search Report dated Sep. 23, 2021 and reported Oct. 4, 2021 for EA app No. 202190488 (3 pages).

* cited by examiner

SLIMLINE STOP COLLAR WITH SOLID CAM RING

BACKGROUND OF THE DISCLOSURE

Field of the Disclosure

The present disclosure generally relates to a slimline stop collar with a solid cam ring.

Description of the Related Art

U.S. Pat. No. 4,101,179 discloses a rigid stabilizer sleeve having outwardly extending ribs is slideably received over a drill collar. A pair of internal clamping rings are slideably received through each end of the rigid main sleeve. As a threaded end cap is threaded into the rigid main sleeve, the end clamp forces one ring of the pair against the other thereby producing a clamping effect whereby the stabilizer can be clamped at any desired position on the drill collar. An outer ring of the pair of rings has a groove and a rib disposed on its interior cylindrical surface; the portion of the end clamp received by the outer ring has a rib and a groove disposed upon its outer cylindrical surface. As the end cap receives the outer ring, the rib and the groove of the end cap interlock with the groove and the rib respectively of the outer ring whereby when the end cap is threadedly removed from the rigid main sleeve, the outer ring follows the end cap and is disengaged from the inner ring, thereby unclamping the pair of rings from the drill collar.

U.S. Pat. No. 4,384,626 discloses a clamp-on stabilizer that fixes the lateral position of a drill string in a borehole. The stabilizer includes a gripping sleeve with slotted and tapered ends, a stabilizer body receiving the sleeve, and a tubular locknut threaded into the body. The lower end of the stabilizer body is internally tapered to engage one tapered end of the gripping sleeve, while a ring abutting the locknut engages the other tapered end. The tapers may be different at each end of the sleeve to produce a sequential locking effect. A full-length longitudinal slot in the sleeve increases the tolerance range for objects to be clamped by the stabilizer.

U.S. Pat. No. 5,860,760 discloses a gripping device which has an inner member and an outer member. The inner member has a split which define a first end and a second end. A selectively operable device is also included to keep the first and second ends apart to permit the device to be placed around an object and to permit the first and second ends to move towards each other so that the inner member grips the object. At least part of an outer face of the inner member interfits with at least a part of an inner face of the outer member in a manner such that when a load is applied to the outer member, the inner face of the outer member acts upon the inner member to cause compression of the inner member thereby increasing the grip of the inner member on the object. The device is then locked in position on the object and when the load is removed the action of the outer member on the inner member is reduced thereby decreasing the grip of the inner member on the object and unlocking the device from the object.

U.S. Pat. No. 8,832,906 discloses a stop collar assembled using a method including the steps of receiving a bore of a base having a set of fingers extending along an exterior of a tubular, receiving a bore of a sleeve onto the tubular adjacent the set of fingers, and receiving the sleeve onto the set of fingers in an interference-fit. In alternate embodiments, the base comprises a plurality of angularly distributed fingers and/or the base comprises a gap to permit conformance of the base to the tubular. A fingerless base may cooperate with one or more separate fingers to form a base. In an embodiment of the method, the sleeve may be thermally expanded prior to the step of receiving the sleeve onto the set of fingers. The sleeve may be heated to expand the bore prior to being received onto the set of fingers.

U.S. Pat. No. 9,598,913 discloses a wear band including a rotating element having a bore receivable on a tubular, the bore including first and second bore portions slidably receiving first and second sleeve bearings. Outer surfaces of the sleeve bearings slidably engage the bore portions and the bores of the sleeve bearings slidably engage the tubular. A first stop collar and a second stop collar may be received on the tubular to together straddle the rotating element and sleeve bearings to longitudinally secure the rotating element in a position on the tubular. The tubular may be included within a tubular string run into a borehole or into the bore of an installed casing, such as in casing while drilling. The rotating element provides stand-off between a tubular and the wall of a bore, reduces frictional resistance to longitudinal sliding and also to rotation of the tubular string within the bore.

U.S. Pat. No. 9,963,942 discloses a centralizer including a centralizer body to be situated at the outer surface of a pipe string in the form of casing, liner, or the like used while drilling, the centralizer body being formed with a plurality of outer centralizer blades arranged in an inclined manner to the longitudinal axis thereof, wherein the centralizer body has an separate split inner tube secured to the pipe string by means of a press fit, and low friction inner surface of the centralizer body and separate center tube facing each other are made from low friction material U.S. Pat. No. 9,982,494 discloses an attachment device for an element made to be arranged on a downhole tubular body, in which an end portion of a sleeve, which is arranged to surround a portion of the tubular body, comprises an attachment portion. The attachment portion comprises at least one clamping element arranged for axial displacement by the abutment of an abutment surface against a conical abutment portion of a surrounding adapter sleeve.

US 2016/0376852 discloses a stabilizer assembly for a tubular member including a stabilizing body dimensioned to fit around the tubular member, a central portion having a radial projection, and a first end having a first threaded outer surface and a set of integral first elastic members. A first nut member includes a proximal end with a threaded inner surface configured to engage the first threaded outer surface of the stabilizing body and a central portion with a first tapered inner surface configured to engage the first elastic members of the stabilizing body. Threading the first nut member onto the first end of the stabilizing body forces the first elastic members to engage the first tapered inner surface of the first nut member thereby radially flexing the first elastic members to engage the tubular member. An inner surface of a distal end of each first elastic member may include a grip section.

US 2020/0109607 discloses a stop collar for mounting to a downhole tubular including: a cylindrical housing having a threaded inner surface and a tapered inner surface; a compressible slip ring having teeth formed in an inner surface thereof and a pair of tapered outer surfaces; a compressible cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular.

SUMMARY OF THE DISCLOSURE

The present disclosure generally relates to a slimline stop collar with a solid cam ring. In one embodiment, a stop collar for mounting to a downhole tubular includes: a cylindrical housing having a threaded inner surface and a tapered inner surface; a compressible slip ring having teeth formed in an inner surface thereof and a pair of tapered outer surfaces; a solid cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
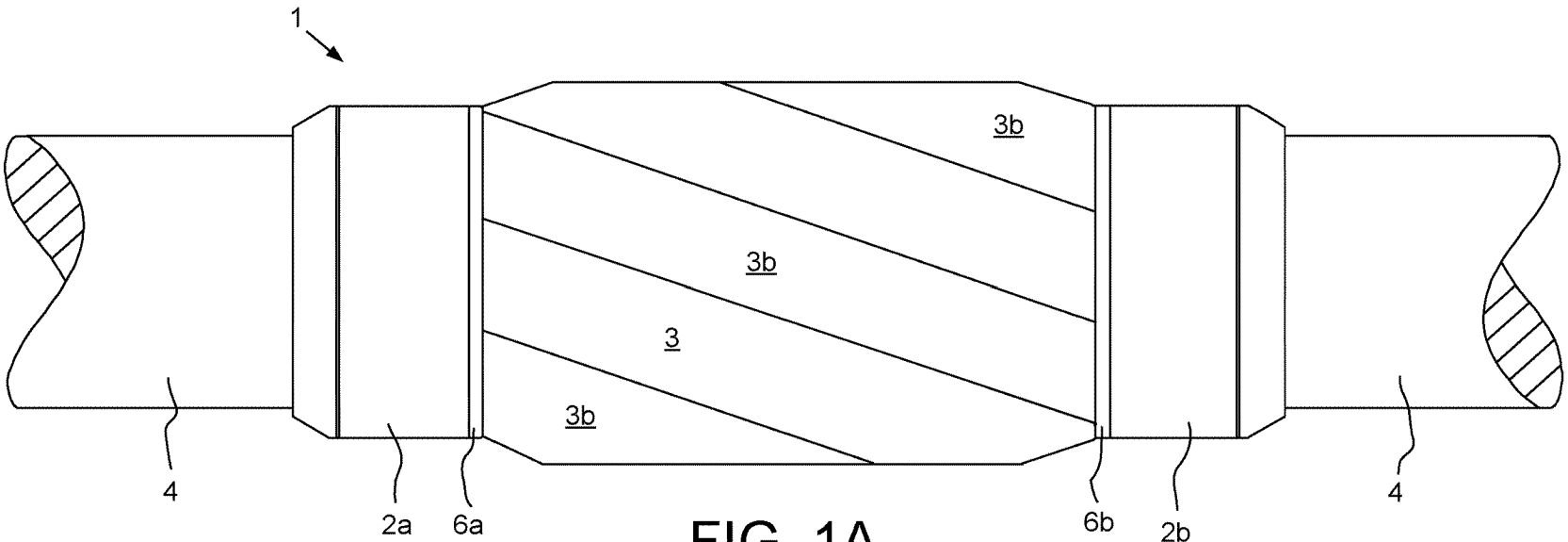
FIG. 1A illustrates a centralizer equipped with a pair of the slimline stop collars, according to one embodiment of the present disclosure.

FIG. 1A illustrates a centralizer 1 equipped with a pair of the slimline stop collars 2*a,b*, according to one embodiment of the present disclosure. FIG. 1B illustrates a body 3 of the centralizer 1 mounted to a downhole tubular 4. The centralizer 1 may include the pair of slimline stop collars 2*a,b*, the body 3, a radial bearing 5, and a pair of thrust bearings 6*a,b*. Each stop collar 2*a,b* may be mounted to the downhole tubular 4, such as casing or liner, and the stop collars may straddle the centralizer 3, thereby trapping the centralizer onto the downhole tubular. The body 3 may be cylindrical and have a plurality (four shown) of blades 3*b* forming a periphery thereof and extending helically there-along. The radial bearing 5 may be a split tube made from one or more materials, such as an inner material and an outer material. The inner material of the radial bearing 5 may be a friction material and a natural inner diameter of the radial bearing may be less than an outer diameter of the downhole tubular 4, thereby forming an interference fit therewith. The outer material of the radial bearing 5 may be a low-friction material to facilitate rotation of the downhole tubular 4 relative to the body 3. An inner portion of the body 3 may also be coated with the low-friction material. Each thrust bearing 6*a,b* may be made from the low-friction material and may be disposed between the radial bearing 5 and a respective stop collar 2*a,b* or between the body 3 and the respective stop collar.

Alternatively, the radial bearing 5 may be a non-split tube. Alternatively, the radial bearing 5 may be made entirely from the low friction material.

A plurality of the centralizers 1 may each be mounted along a string of downhole tubulars 4, such as a casing or liner string, that will be drilled into a wellbore (not shown) adjacent to an unstable or depleted formation. The centralizers 1 may be spaced along the portion of the string of downhole tubulars 4 at regular intervals. Drilling the string of downhole tubulars 4 into the wellbore adjacent to the unstable or depleted formation is advantageous to using a drill string to prevent collapse or loss of drilling fluid due to the unstable or depleted formation. The string of downhole tubulars 4 may further include a casing bit screwed in at a bottom thereof and may be rotated by a top drive during drilling either directly or via a work string of drill pipe extending from the top of the string of downhole tubulars 4 to the top drive. During drilling, drilling fluid, such as mud, may be pumped down a bore of the string of downhole tubulars 4, may be discharged from the casing bit, and may return to surface via an annulus formed between the string of downhole tubulars 4 and the wellbore. The string of downhole tubulars 4 may have premium connections to withstand drilling torque exerted thereon by the top drive. The string of downhole tubulars 4 may further include a float collar located adjacent to the casing bit and a deployment assembly located at an upper end thereof including a hanger, a packer, and one or more wiper plugs. Once the string of downhole tubulars 4 has been drilled into place, the hanger may be set, cement slurry may be pumped into the annulus, and the packer set, thereby installing the string of downhole tubulars into the wellbore. The casing bit may then be drilled through to facilitate further drilling of the wellbore to a hydrocarbon bearing formation, such as crude oil and/or natural gas.

Figure 1C:
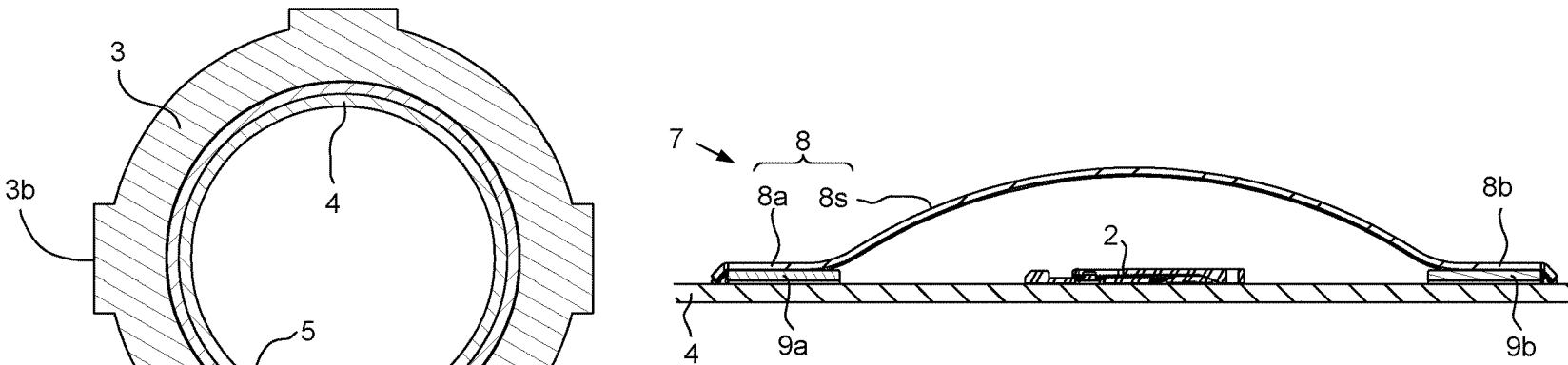
FIG. 1C illustrates a typical one of the slimline stop collars being used with a resilient centralizer instead of the (rigid) centralizer, according to another embodiment of the present disclosure.
Figure 1B:
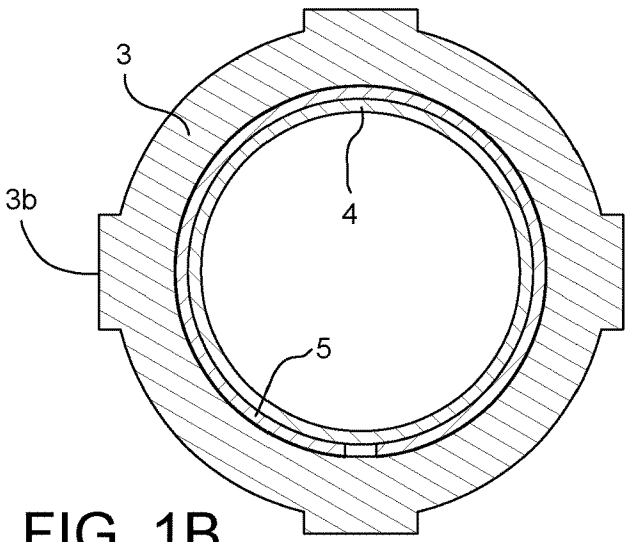
FIG. 1B illustrates a body of the centralizer mounted to a downhole tubular.

FIG. 1C illustrates a typical one 2 of the slimline stop collars 2*a,b* being used with a resilient centralizer 7 instead of the (rigid) centralizer 1, according to another embodiment of the present disclosure. The resilient centralizer 7 may include a pair of end collars 9*a,b*, a body 8, and the typical slim line stop collar 2. The body 8 may have a pair of end rings 8*a,b* and a plurality of bow springs 8*s* extending therebetween. The bow springs 8*s* may be spaced around the body 8 at regular intervals, such as eight bow springs spaced at forty-five degree intervals. Bypass passages may be formed between the bow springs 8*s* to accommodate fluid flow through an annulus formed between the downhole tubular 4 and the wellbore. The bow springs 8*s* may each be identical and radially movable between an expanded position (shown) and a retracted position (not shown). The bow springs 8*s* may have a parabolic shape in the expanded position.

The body 8 may longitudinally extend when moving from the expanded position to the retracted position and longitudinally contract when moving from the retracted position to the expanded position. The bow springs 8*s* may be naturally biased toward the expanded position and an expanded diameter of the centralizer 7 may correspond to a diameter of the wellbore. Engagement of the bow springs 8*s* with a wall of the wellbore may move the downhole tubular 4 toward a central position within the wellbore to ensure that a uniform cement sheath is formed around the downhole tubular during the cementing operation. The body 8 may be formed from a single sheet of spring steel by cutting out slots to form strips which will become the bow springs 8*s*. The body 8 may be formed into a tubular shape by rolling the cut sheet and welding seams of the end rings 8*a,b* together. The bow springs 8*s* may have the natural bias toward the expanded position by being held therein during heat treatment of the body 8.

After the body 8 has been formed, each end collar 9*a,b* may be inserted into the respective end rings 8*a,b*. Each end collar 9*a,b* may be formed to be a tight fit within the end rings 8*a,b*. Each end collar 9*a,b* may then be spot-welded to the respective end rings 8*a,b*. A lip of each end ring 8*a,b* extending past the respective collar 9*a,b* may be split into a multitude of tabs (before or after insertion of the collars) and the tabs may be bent over the respective end collar, thereby mounting the collars to the body 8 (in addition to the spot welds). The stop collar 2 may be located between the end collars 9*a,b* by insertion through one of the slots between the bow springs 8*s* before the centralizer 7 is slid over the periphery of the downhole tubular 4. Setting of the stop collar 2 may trap the centralizer 7 into place along the downhole tubular 4 while allowing limited longitudinal movement of the body 8 relative thereto to accommodate movement between the positions.

Alternatively, the centralizer 7 may include a pair of slimline stop collars 2*a,b* straddling the end rings 8*a,b* instead of the single stop collar 2 located therebetween.

Figure 2:
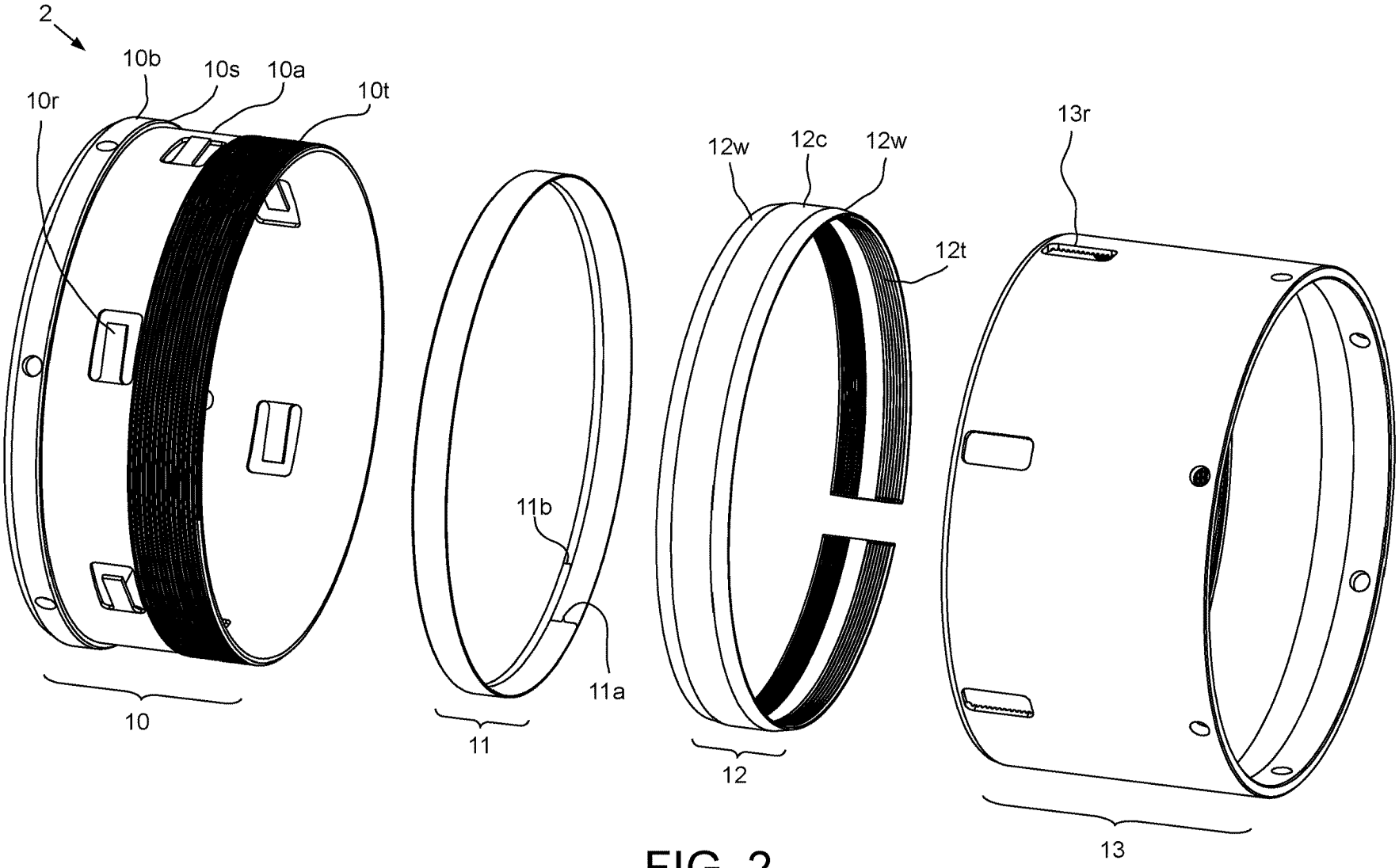
FIG. 2 illustrates an arrangement of the typical slim line stop collar.
Figure 5A:
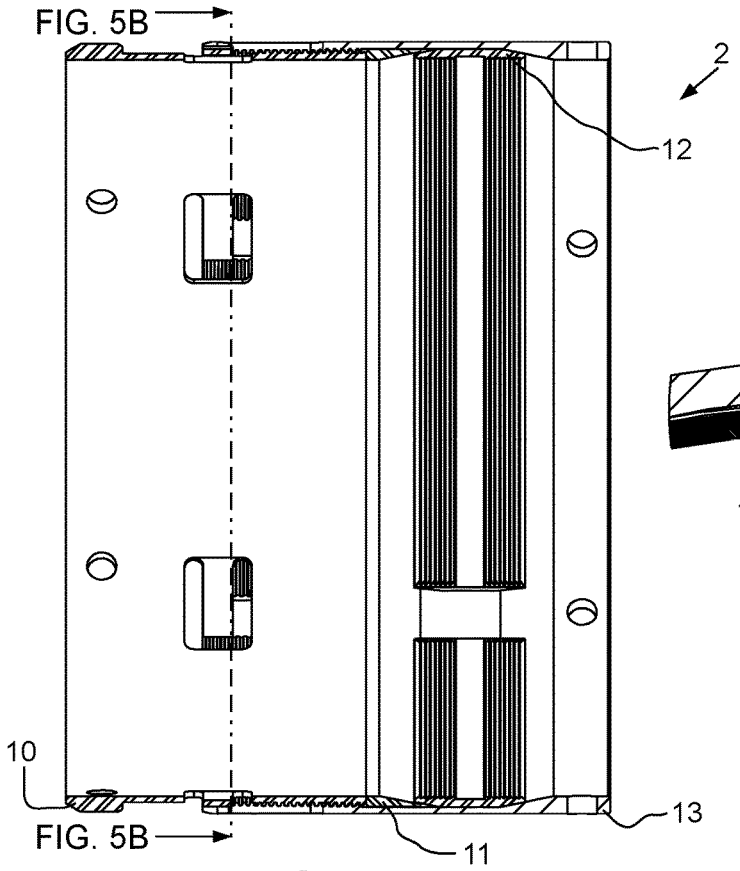
FIG. 5A illustrates the assembled typical slimline stop collar in a disengaged position.

FIG. 2 illustrates an arrangement of the typical slimline stop collar 2. The typical stop collar 2 may include a bolt 10, the solid cam ring 11, a slip ring 12, a housing 13, and a locking system 14 (FIG. 5B). Each of the components 10-14 may be made from a metal or alloy, such as steel. The locking system 14 may include a ratchet profile 13*r* of the housing 13 and a ratchet profile 10*r* of the bolt 10.

Figure 3A:
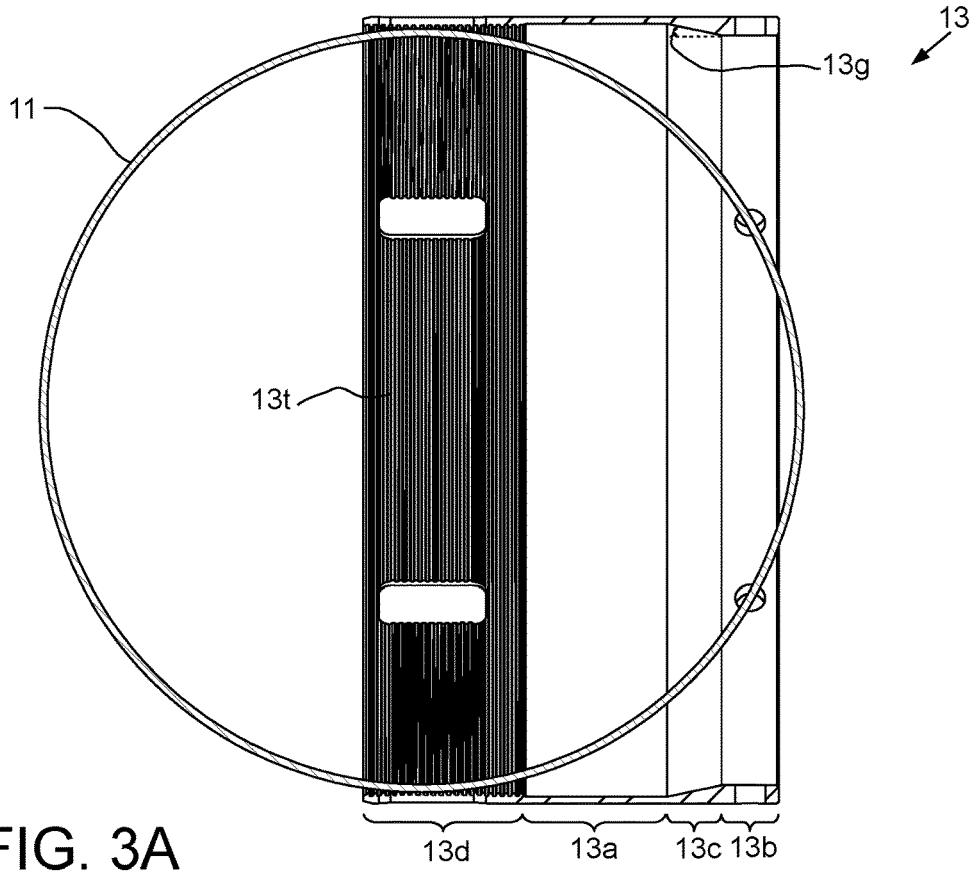
FIGS. 3A and 3B illustrate insertion of the solid cam ring into a housing of the typical slim line stop collar.

Referring also to FIG. 3A, the housing 13 may be cylindrical and have a first portion 13*a* with an enlarged inner diameter for receiving the slip ring 12 and the cam ring 11, a second portion 13*b* with a reduced inner diameter for engagement with one of the thrust bearings 6*a,b*, a third portion 13*c* with a tapered inner surface connecting the first and second portions, and a fourth portion 13*d* having a threaded 13*t* inner surface partially split by the ratchet profile 13*r*, extending from an end of the housing to the first portion, and having the ratchet profile along a portion thereof. The ratchet profile 13*r* may include a series of circumferentially spaced and longitudinally extending catches, such as slots, for receiving the tabs of the ratchet profile 10*r* of the bolt 10. The inner diameters of the first portion 13*a* and second portion 13*b* may each be constant. The housing 13 may also have a plurality of holes formed through a wall of the first portion 13*a* for facilitating assembly (discussed below). The inner thread 13*t* of the fourth portion 13*d* may be for mating with a threaded surface 10*t* of the bolt 10. The forms of the threads 13*t*, 10*t* may be lead screws for driving engagement of the slip ring 12 with a periphery of the downhole tubular 4. The taper angle 13*g* relative to an axis parallel to a longitudinal axis of the downhole tubular 4 may range between five and twenty-five degrees.

The slip ring 12 may have a central portion 12*c* with a constant diameter outer surface and a pair of working portions 12*w*, each working portion having a tapered outer surface declining away from the central portion. The taper of each working portion 12*w* may correspond to the taper of the third portion 13*c* of the housing 13. An inner surface of each working portion 12*w* may have a plurality of circumferential teeth 12*t* (aka wickers) formed therein. Each tooth 12*t* may have a cross sectional shape resembling a right triangle and the hypotenuses of the teeth of each working portion 12*w* may incline toward the central portion 12*c*, thereby providing bidirectional gripping of the downhole tubular 4. The slip ring 12 may be split (aka C-shape) for compression between a natural position (shown) and a compressed position (FIG. 6B). In the natural position, an outer diameter of the central portion 12*c* may be greater than a minor diameter of the threads 13*t*, 10*t* and about equal (plus or minus ten percent) to the inner diameter of the first portion 13*a* of the housing 13.

Alternatively, the slip ring 12 may be partially split by a plurality of slots extending radially through a wall thereof, each slot extending from one end of the slip ring, along the respective working portion 12*w* and the center portion 12*c*, and terminating in the other working portion before reaching the other end of the slip ring. Alternatively, the teeth 12*t* of the slip ring 12 may all be inclined in the same direction, thereby providing only monodirectional gripping of the downhole tubular 4 and the slip ring may have an orientation indicator, such as an arrow, on a periphery thereof, such as by adhering, engraving, or painting. Alternatively, the teeth 12*t* of the slip ring 12 may all be inclined away from the central portion.

The solid cam ring 11 may have a first portion 11*a* with a tapered inner surface for engagement with one of the working portions 12*w* of the slip ring 12 and a second portion 11*b* with a reduced inner diameter for engagement with an end of the bolt 10. The solid cam ring 11 may have a constant outer diameter (excluding a chamfer formed at each end thereof). The taper of the first portion 11*a* may correspond to the taper of the working portions 12*w* of the slip ring 12. By solid, it is meant that the cam ring has a solid wall (no slots) and is not split. The metal or alloy of the cam ring 11 may possess sufficient resilience to allow elastic compression of the cam ring between a natural position (shown) and a compressed position (FIG. 3A). In the natural position, the outer diameter of the cam ring 11 may be greater than a minor diameter of the threads 13*t*, 10*t* and less than or equal to the inner diameter of the first portion 13*a* of the housing 13.

The bolt 10 may be cylindrical and have a first portion 10*a* with a reduced outer diameter and the thread 10*t* formed in an outer surface thereof and extending from an end thereof, a second portion 10*b* with an enlarged outer diameter, the ratchet profile 10*r* formed in the first portion, and a shoulder 10*s* connecting the first and second portions. The bolt 10 may also have a plurality of holes formed through a wall of the second portion 10*b* for facilitating assembly (discussed below). The minor diameter of the threads 13*t*, 10*t* may be less than the inner diameter of the first portion 13*a* of the housing 13.

Figure 5C:
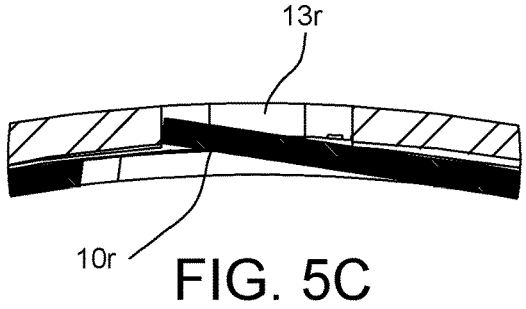
FIGS. 5B and 5C illustrate operation of a locking system of the typical slimline stop collar.
Figure 5B:
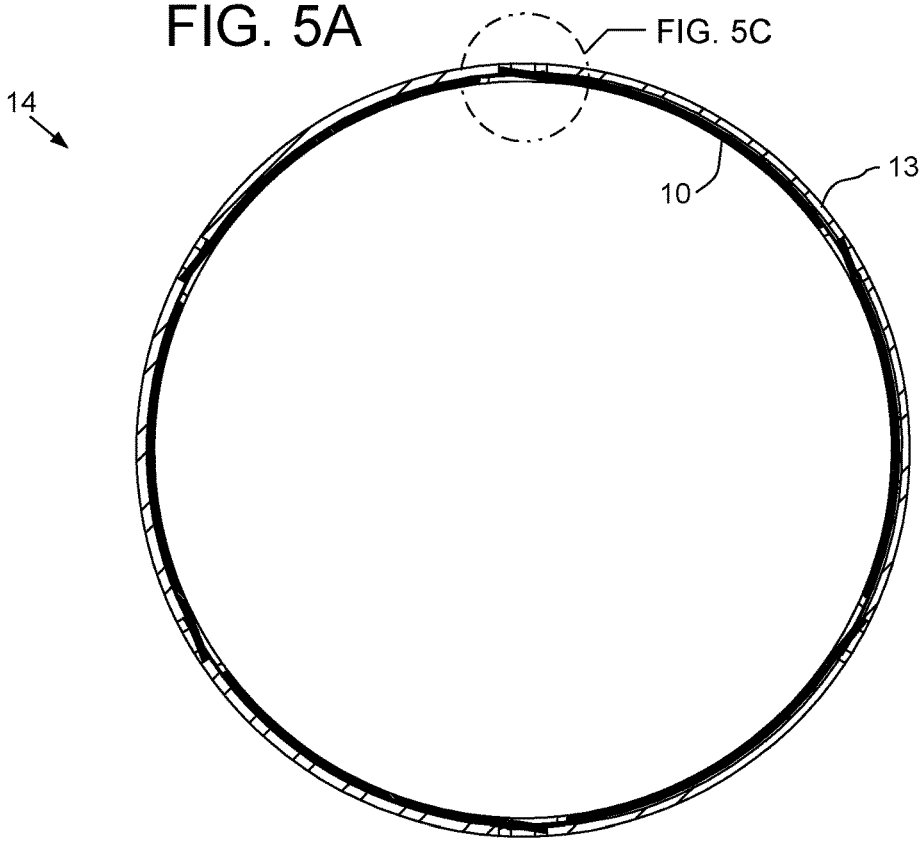

Referring also to FIGS. 5B and 5C, the ratchet profile 10*r* may include a circumferential row of openings and cantilevered tabs disposed in the openings and extending radially outward as the tabs extend circumferentially thereacross. The ratchet profile 10*r* may be located adjacent to the thread 10*t* and between the thread and the shoulder 10*s*. The ratchet profiles 10*r*, 13*r* may be configured such that the rotation is allowed in the tightening direction of rotation of the bolt 10 relative to the housing 13 but prevented in the loosening direction thereof. This is due to free ends of the tabs having a natural effective diameter greater than a major diameter of the threaded surface 13*t* to ensure that the tabs engage the slots of the ratchet profile 13*r*.

Figure 3B:
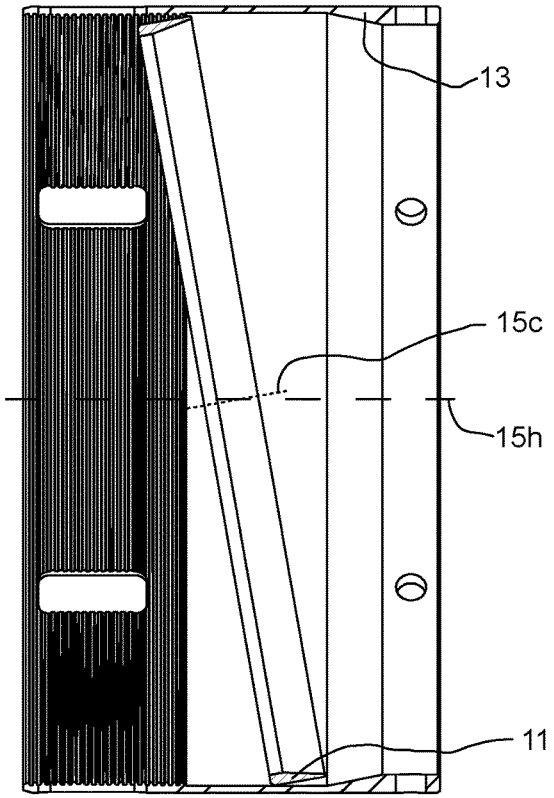

FIGS. 3A and 3B illustrate insertion of the solid cam ring 11 into the housing 13 of the typical slimline stop collar 2. To begin assembly, the cam ring 11 may be rotated such that a longitudinal axis 15*c* thereof is perpendicular to a longitudinal axis 15*h* of the housing 13. The cam ring 11 may be compressed so that a portion of the outer diameter thereof is less than or equal to the minor diameter of the thread 13*t* of the housing 13. The compressed cam ring 11 may then be inserted through the thread 13*t* and into the bore of the first portion 13*a* of the housing 13 until the compressed cam ring engages the tapered third portion 13*c* of the housing. The compressed cam ring 11 may then again be rotated until the longitudinal axis 15*c* thereof is parallel to the longitudinal axis 15*h* of the housing 13. Such rotation may require some flexing of the cam ring 11. Once rotated into place, the cam ring 11 may then expand to the natural position thereof (compression is solely elastic, not plastic) and be slid along the bore of the first portion 13*a* of the housing 13 until the cam ring is adjacent to the housing thread 13*t*.

Alternatively, the cam ring 11 may be inserted into the housing 13 via the non-threaded end thereof adjacent to the second housing section 13*b* instead of the threaded end thereof adjacent to the fourth housing section 13*d*. Alternatively, the cam ring 11 may be partially deformed while being inserted into the housing 13 and at least partially deformed back towards its original shape, either prior to or during being positioned parallel to the longitudinal axis 15*h* thereof (compression is partially plastic).

Figure 4A:
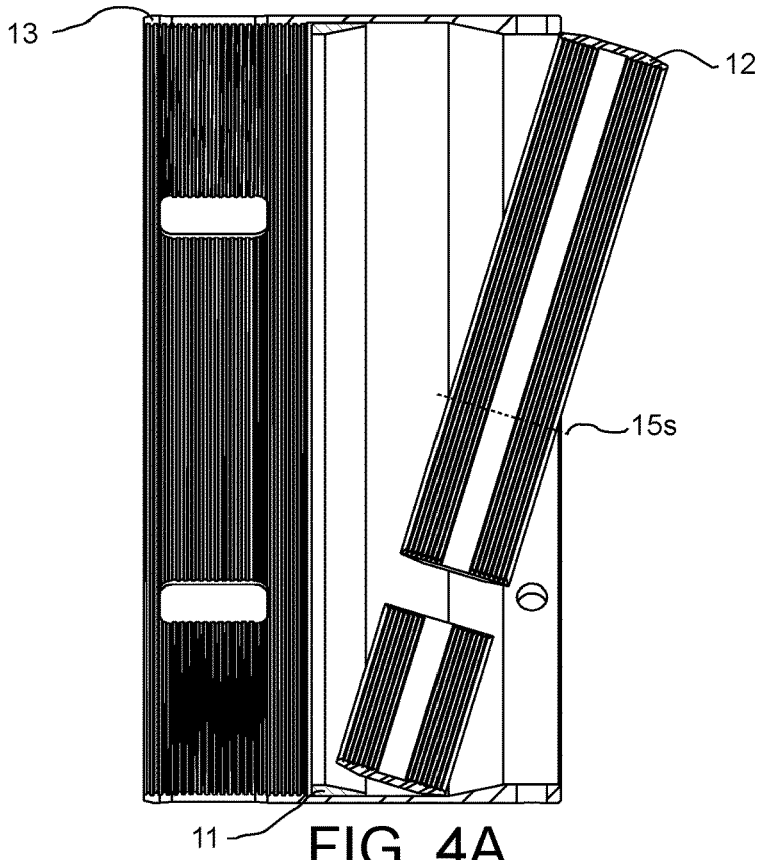
FIG. 4A illustrates insertion of a slip ring into the housing of the typical slimline stop collar.

FIG. 4A illustrates insertion of the slip ring 12 into the housing 13 of the typical slimline stop collar 2. Once the cam ring 11 has been properly positioned within the housing 13, the slip ring 12 may be rotated such that a longitudinal axis 15*s* thereof is at an acute angle to the longitudinal axis 15*h* of the housing 13. The slip ring 12 may then be inserted into the non-threaded end of the housing 13 adjacent to the second housing section 13*b* until the non-inserted end of the slip ring 12 is adjacent to the non-threaded end of the housing. The slip ring 12 may then be compressed such that the non-inserted end of the slip ring may slide underneath the inner surface of the second housing section 13*b*, and the non-inserted end of the slip ring may then be so slid, thereby rotating the slip ring into place along the bore of the first housing section 13*a* and in partial engagement with the cam ring 11 and the tapered surface of the third housing section 13*c*.

Figure 4B:
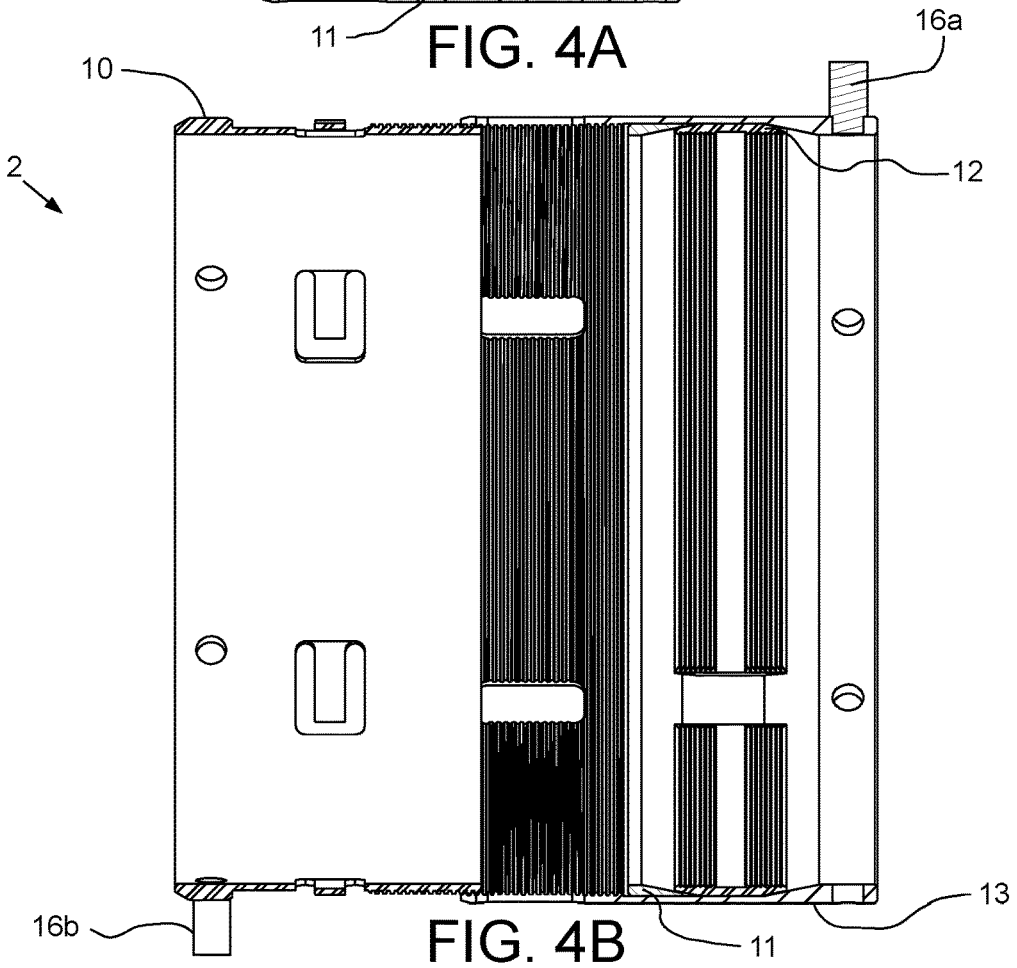
FIG. 4B illustrates screwing of a bolt into the housing of the typical slimline stop collar.

FIG. 4B illustrates screwing of the bolt 10 into the housing 13 of the typical slimline stop collar 2. Once the slip ring 12 has been properly positioned within the housing 13, the thread 10*t* of the bolt 10 may be engaged with the housing thread 13*t*. A first torque rod 16*a* may be inserted into one of the holes of the second housing section 13*b* and a second torque rod 16*b* may be inserted into one of the holes of the second bolt section 10*b*. Using the torque rods 16*a,b*, the bolt 10 may be rotated relative to the housing 13 in a tightening direction, thereby advancing the bolt toward the housing until a threaded end of the bolt is adjacent to the cam ring 11 and the ratchet profile 10*r* of the bolt has begun engagement with the ratchet profile 13*r* of the housing 13, thereby placing the typical slimline stop collar 2 in a disengaged position.

FIG. 5A illustrates the assembled typical slimline stop collar 2 in the disengaged position. The torque rods 16*a,b* may be removed and the disengaged stop collar 2 may then be slid over the downhole tubular 4 until the non-threaded end of the housing 13 engages one of the thrust bearings 6*a,b*.

Figure 6A:
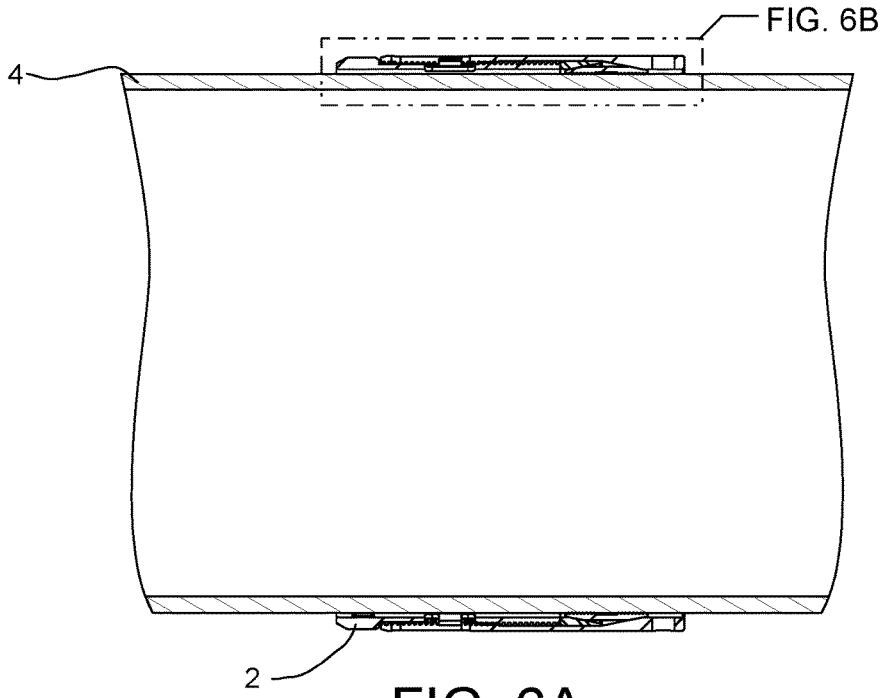
FIGS. 6A and 6B illustrate the typical slimline stop collar engaged with the downhole tubular.
Figure 6B:
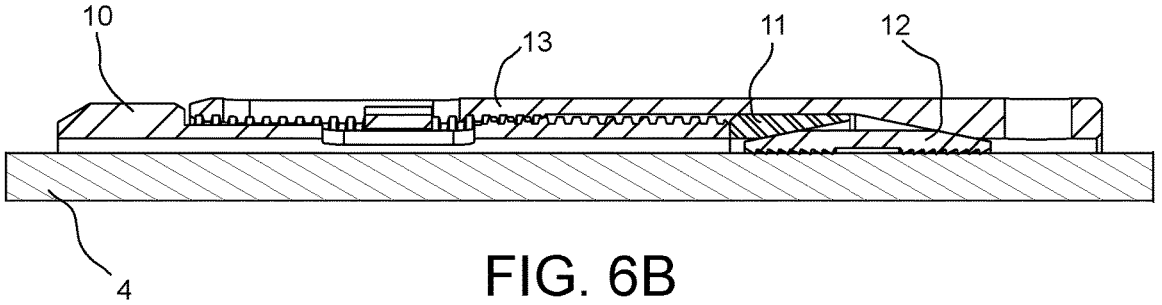

FIGS. 6A and 6B illustrate the typical slimline stop collar 2 engaged with the downhole tubular 4. Once the disengaged stop collar 2 has been positioned along the downhole tubular 4, the torque rods 16*a,b* may be re-inserted and the bolt 10 may be further rotated relative to the housing 13 in the tightening direction, thereby further advancing the bolt into the housing. During continued rotation of the bolt 10 relative to the housing 13, the threaded end of the bolt may engage the non-tapered end of the of the cam ring 11 and drive the cam ring toward the slip ring 12. During continued rotation of the bolt 10 relative to the housing 13, the tapered first portion 11*a* of the cam ring 11 may slide over the adjacent working portion 12*w* of the slip ring 12 until the mating tapered surfaces thereof engage, thereby driving the distal end surface thereof into engagement with the mating tapered surface of the third portion 13*c* of the housing. During continued rotation of the bolt 10 relative to the housing 13, the tapered first portion 11*a* of the cam ring 11 may continue to slide over the adjacent working portion 12*w* of the slip ring 12 and advancement of the slip ring along the tapered inner surface of the third portion 13*c* of the housing may continue, thereby radially compressing the slip ring 12 toward the periphery of the downhole tubular 4. Radial compression of the slip ring 12 may continue until the teeth 12*t* thereof engage and penetrate the periphery of the downhole tubular 4, thereby longitudinally and torsionally mounting the stop collar 2 to the downhole tubular.

Also during continued rotation of the bolt 10 relative to the housing 13, the tabs of the ratchet profile 10*r* may engage the slots of the ratchet profile 13*r*. Since the bolt 10 is being rotated in a tightening direction, a joined end of each tab may enter and exit the respective slot before the free end of the tab, thereby allowing walls of the slot to compress the tab so that rotation in the tightening direction is not obstructed. Operation of the locking system 14 prevents rotation of the bolt 10 in the loosening direction during deployment of the centralizer 1, which could be caused by vibration. There may be some acceptable backlash until the ratchet profiles 10*r*, 13*r* engage depending on the relative positions of the bolt 10 and the housing 13 at full engagement of the slip ring 12.

Alternatively, the stop collar 2 may be installed on the downhole tubular 4 with the bolt 10 located adjacent to one of the thrust bearings 6*a,b* instead of the housing 13 located adjacent thereto.

Advantageously, use of the solid cam ring 11 instead of a split or slotted cam ring provides for a stronger stop collar 2 as the cam ring serves as a hoop stress support member, thereby reinforcing the thinner first portion 13*a* of the housing 13. The radial gap that would necessarily result from a use of a split cam ring is eliminated. In the engaged position of the stop collar 2, the cam ring 11 may be loaded primarily or solely in the elastic range, such that the equivalent tensile stress is less than or equal to the yield strength of the cam ring material.

Figure 6C:
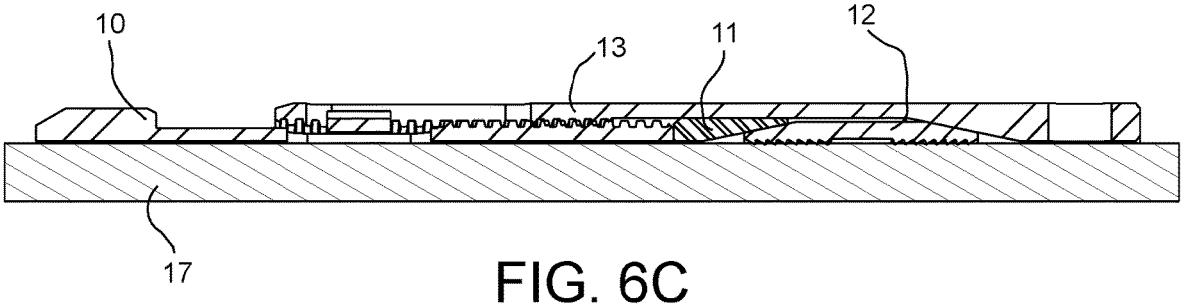
FIG. 6C illustrates the typical slimline stop collar engaged with a second larger downhole tubular.

FIG. 6C illustrates the typical slimline stop collar 2 engaged with a second larger downhole tubular 17. The stop collar 2 may accommodate variation in the size of the downhole tubulars 4, 17, such that FIG. 6B illustrates the maximum gap between the outer surface of the downhole tubular 4 and the inner diameter of the second housing section 13*b* usable therewith and FIG. 6C illustrates the minimum gap between the outer surface of the second downhole tubular 17 and the inner diameter of the second housing section 13*b* usable therewith.

Figure 7A:
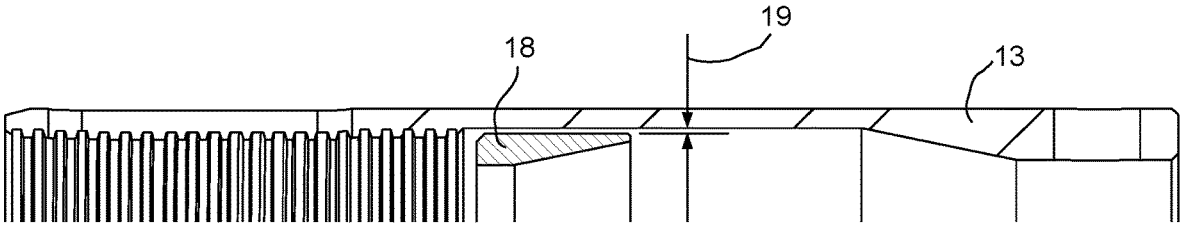
FIG. 7A illustrates an alternative solid cam ring inserted into the housing of the typical slimline stop collar, according to another embodiment of the present disclosure.

FIG. 7A illustrates an alternative solid cam ring 18 inserted into the housing 13 of the typical slimline stop collar, according to another embodiment of the present disclosure. The alternative cam ring 18 may replace the cam ring 11, thereby forming an alternative typical stop collar. The alternative typical stop collar may include the bolt 10, the alternative solid cam ring 18, the slip ring 12, the housing 13, and the locking system 14 (FIG. 5B). The alternative cam ring 18 may have a smaller outer diameter than the cam ring 11, thereby forming a gap 19 between the outer surface thereof and the inner surface of the first portion 13*a* of the housing 13. The size of the gap 19 and the amount of expansion shown in FIG. 7B may be exaggerated for illustration purpose. Other than the smaller outer diameter, the alternative cam ring 18 may be similar or identical to the cam ring 11. The reduced outer diameter of the alternative cam ring 18 may be greater than the minor diameter of the threads 13*t*, 10*t* and less than the inner diameter of the first portion 13*a* of the housing 13, such as less than or equal to ninety-nine percent, ninety-eight percent, ninety-seven percent, ninety-six percent, ninety-five percent, ninety-four percent, ninety-three percent, ninety-two percent, ninety-one percent, or ninety percent of the inner diameter of the first portion 13*a* of the housing 13.

Alternatively, the reduced outer diameter of the alternative cam ring 18 may be greater than the minor diameter of the threads 13*t*, 10*t* and less than or equal to the major diameter of the threads 13*t*, 10*t*.

Figure 7B:
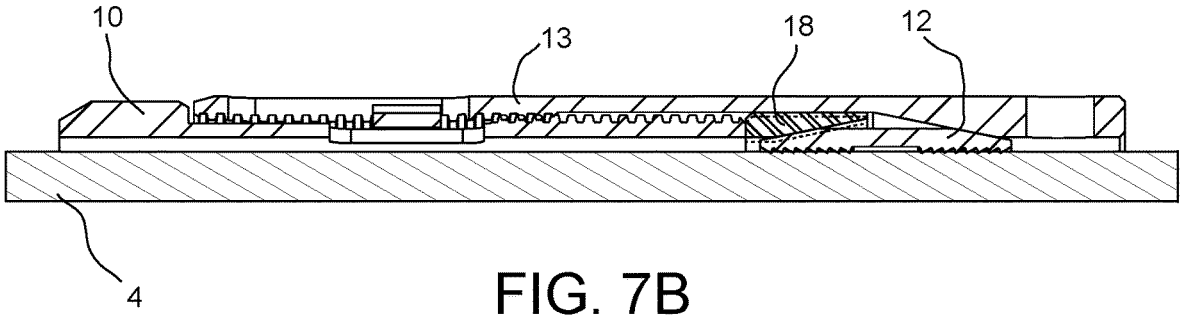
FIG. 7B illustrates expansion of the alternative solid cam ring during engagement of the slip ring with the downhole tubular.

FIG. 7B illustrates expansion of the alternative solid cam ring 18 during engagement of the slip ring 12 with the downhole tubular 4. The natural position of the alternative solid cam ring 18 is shown in phantom. During continued rotation of the bolt 10 relative to the housing 13, the threaded end of the bolt may engage the non-tapered end of the of the alternative solid cam ring 18 and drive the cam ring toward the slip ring 12. During continued rotation of the bolt 10 relative to the housing 13, the tapered first portion of the cam ring 18 may slide over the adjacent working portion 12*w* of the slip ring 12 until the mating tapered surfaces thereof engage, thereby driving the distal end surface thereof into engagement with the mating tapered surface of the third portion 13*c* of the housing. During continued rotation of the bolt 10 relative to the housing 13, the tapered first portion of the cam ring 18 may continue to slide over the adjacent working portion 12*w* of the slip ring 12 and advancement of the slip ring along the tapered inner surface of the third portion 13*c* of the housing may continue, thereby radially compressing the slip ring 12 toward the periphery of the downhole tubular 4 and radially expanding the cam ring 18. Radial compression of the slip ring 12 may continue until the teeth 12*t* thereof engage and penetrate the periphery of the downhole tubular 4, thereby longitudinally and torsionally mounting the alternative stop collar to the downhole tubular.

Advantageously, radial expansion of the alternative solid cam ring 18 adds pre-load or strain in the alternative stop collar. The cam ring 18 may act as a hoop spring thereby ensuring that the slip ring 12 maintains its grip on the tubular 4. The cam ring 18 may even be expanded beyond its yield strength, thereby strain hardening the cam ring.

While the foregoing is directed to embodiments of the present disclosure, other and further embodiments of the disclosure may be devised without departing from the basic scope thereof, and the scope of the invention is determined by the claims that follow.

The invention claimed is:

1. A stop collar for mounting to a downhole tubular, comprising:
- a cylindrical housing having a threaded inner surface and a tapered inner surface;
- a compressible slip ring having teeth formed in an inner surface thereof and a pair of tapered outer surfaces;
- a solid cam ring having a tapered inner surface; and
- a cylindrical bolt having a threaded outer surface,
- wherein:
  - a natural outer diameter of each ring is greater than a minor diameter of the threaded surfaces, and
  - screwing the threaded surfaces of the housing and the bolt is operable to drive the tapered surfaces together, thereby compressing the slip ring such that the teeth engage a periphery of the downhole tubular.

2. The stop collar of claim 1, wherein the solid cam ring is made from a resilient material to allow elastic compression thereof.

3. The stop collar of claim 1, wherein the slip ring is split.

4. The stop collar of claim 1, wherein the tapered surfaces have corresponding angles relative to a longitudinal axis of the downhole tubular and the angles each range between five and twenty-five degrees.

5. The stop collar of claim 1, wherein:
- the slip ring has a central portion with a constant diameter outer surface and a pair of working portions,
- each working portion has one of the tapered outer surfaces declining away from the central portion,
- each working portion has some of the teeth.

6. The stop collar of claim 1, further comprising a locking system operable to prevent unscrewing of the threaded surfaces of the housing and the bolt.

7. The stop collar of claim 6, wherein the locking system comprises:
- a ratchet profile formed in the bolt adjacent to the threaded surface thereof, and
- a ratchet profile formed in the housing and configured to engage the ratchet profile of the bolt as the threaded surfaces of the bolt and housing are screwed together.

8. The stop collar of claim 7, wherein the ratchet profile of the housing is a plurality of slots formed through a wall of the housing and partially splitting the threaded inner surface.

9. The stop collar of claim 1, wherein:
- the housing has a first portion with a constant inner diameter for receiving the cam ring,
- a gap is formed between an outer surface of the cam ring in a natural position thereof and an inner surface of the first portion of the housing.

10. The stop collar of claim 9, wherein the natural outer diameter of the cam ring is less than or equal to 95% of the inner diameter of the first portion of the housing.

11. The stop collar of claim 9, wherein the natural outer diameter of the cam ring is less than or equal to a major diameter of the threaded surfaces.

12. A centralizer comprising:

a body having a plurality of blades forming a periphery thereof; and a pair of stop collars, each stop collar of claim 1 for mounting the centralizer body to the downhole tubular.

13. A centralizer comprising:

a body having a plurality of bow springs forming a periphery thereof; and a stop collar of claim 1 for mounting the centralizer body to the downhole tubular by being disposed between ends of the body.

14. A method of assembling the stop collar of claim 1, comprising:

rotating the solid cam ring such that a longitudinal axis thereof is perpendicular to a longitudinal axis of the housing;

compressing the solid cam ring and inserting the compressed cam ring through an inner surface of the housing; and after insertion, rotating the cam ring until the longitudinal axis thereof is parallel to the longitudinal axis of the housing.

15. A centralizer comprising:

a body having a plurality of bow springs forming a periphery thereof; and a pair of stop collars, each stop collar of claim 1 for mounting the centralizer body to the downhole tubular.

* * * * *